US007775913B2

(12) United States Patent
Woods

(10) Patent No.: US 7,775,913 B2
(45) Date of Patent: Aug. 17, 2010

(54) ATHLETIC TRAINING DEVICE

(76) Inventor: Dennis W. Woods, 2002 Woody Ct., Prole, IA (US) 50229

( * ) Notice: Subject to any disclaimer, the term of this patent is extended or adjusted under 35 U.S.C. 154(b) by 0 days.

(21) Appl. No.: 12/075,353

(22) Filed: Mar. 11, 2008

(65) Prior Publication Data

US 2009/0233736 A1 Sep. 17, 2009

(51) Int. Cl.
*A63B 69/00* (2006.01)

(52) U.S. Cl. ..... 473/430; 473/423; 473/459

(58) Field of Classification Search ..... 473/422, 473/423, 429, 430, 459, 465, 473, 474
See application file for complete search history.

(56) References Cited

U.S. PATENT DOCUMENTS

| | | | | |
|---|---|---|---|---|
| 3,262,703 | A * | 7/1966 | Hodlick | 473/474 |
| 3,948,517 | A * | 4/1976 | Feiler | 473/429 |
| 4,664,375 | A * | 5/1987 | Tetreault | 473/429 |
| 5,246,226 | A * | 9/1993 | McGuinn | 473/429 |
| 5,427,369 | A * | 6/1995 | Baquet, Jr. | 473/429 |
| 5,467,978 | A * | 11/1995 | Paluch | 473/429 |
| 5,842,938 | A * | 12/1998 | Garber | 473/430 |
| 5,957,781 | A * | 9/1999 | Kelly | 473/140 |
| 6,334,821 | B1 * | 1/2002 | Kita | 473/430 |
| 6,729,978 | B2 * | 5/2004 | Moss et al. | 473/430 |
| 6,790,150 | B1 * | 9/2004 | Moss et al. | 473/430 |
| 7,186,193 | B1 * | 3/2007 | McFadden, Jr. | 473/459 |
| 7,198,579 | B2 * | 4/2007 | Moss et al. | 473/430 |
| 7,223,186 | B2 * | 5/2007 | Tresvant | 473/447 |
| 2003/0064836 | A1 * | 4/2003 | Moss et al. | 473/417 |
| 2003/0224880 | A1 * | 12/2003 | Hansberry | 473/430 |
| 2004/0176191 | A1 * | 9/2004 | Moss et al. | 473/430 |
| 2005/0113193 | A1 * | 5/2005 | Wardle et al. | 473/459 |
| 2005/0288127 | A1 * | 12/2005 | Moss et al. | 473/430 |

* cited by examiner

*Primary Examiner*—Raleigh W. Chiu
(74) *Attorney, Agent, or Firm*—Brett Trout

(57) ABSTRACT

Tennis balls are releasably connected to a string depending from a support. When the user strikes the ball, the ball releases from the string and the string automatically retracts into the support to reduce interference of the string with a user's subsequent stroke. The system is fully adjustable to replicate shots ranging from a ground shot to an overhead service. The system is lightweight, portable, and adaptable to a plurality of sports.

20 Claims, 10 Drawing Sheets

ATHLETIC TRAINING DEVICE

BACKGROUND OF THE INVENTION

1. Field of the Invention

The present invention relates in general to an athletic training device and, more particularly, to a tennis training device for suspending a tennis ball for use in improving a user's tennis swing.

2. Description of the Prior Art

It is known in the art to provide various types of tethered ball training devices. Volley balls "tethered" by rope to a pole are used in association with a variety of games. Similarly, golf balls connected to a support can be used to aid in improving a golf swing. One drawback associated with these prior art devices, however, is the inability to experience accurate follow through after the user has contacted the ball. With the rope, string or other retainer connected directly to the ball, after the user contacts the ball, the ball moves in a direction dictated by the retainer, rather than in a true direction dictated by the impact provided by the user.

An additional drawback associated with such prior art training devices is the tendency of the retaining device, represented by either a rope, string or similar object, impeding the user's stroke. It would, therefore, be desirable to reduce deviation of the user's stroke associated with the retainer and to prevent the retainer from impeding the user's stroke.

Still another drawback associated with prior art devices is the inability to simulate strokes of various heights. For baseball training devices, it is not necessary to simulate many swings outside of the batter's box. Similarly, in golf it is not necessary to simulate strokes much above the ground. In tennis, however, it would be desirable to replicate strokes from very near the ground to above the user's head. It would additionally be desirable to replicate a serving stroke which may be a meter or more above the user's head. It would, therefore, be desirable to provide a training device which could be readily adapted to replicate a plurality of stroke heights from those near the ground to those substantially above the user's head.

An additional drawback associated with prior art training devices is the difficulty in practicing top spin, back spin and slice shots. Practicing tennis shots typically involves either the user bouncing a ball or returning a ball from a machine or coach. The speed with which a player has to react to such a dynamic training scenario makes it difficult to focus on applying torque to the ball during the stroke. Additionally, such prior art teaching systems often apply a spin to the ball, making it difficult to determine whether it is the user's torque or the existing spin affecting the ball as it leaves the user's racket. It would therefore be desirable to provide a tennis ball in a type of "suspended animation" in a manner which allows the ball to be provided without existing spin to not only give the user more time to concentrate on applying torque to the ball, but also to assess the affect of applying torque to the ball without the interference of a pre-existing spin.

Still another drawback associated with the prior art is the requirement of a heavy, bulky training device which is not easily relocated from one position to another. It would, therefore, be desirable to provide a lightweight portable device which may be easily compacted and moved to various locations. Based on the foregoing, it would be desirable to provide a lightweight portable athletic training device which is easily adjustable to simulate strokes from near the ground to above a user's head, and which provides more accurate feedback relative to a stroke after contact with the ball is made. The difficulties encountered in the prior art discussed hereinabove are substantially eliminated by the present invention.

SUMMARY OF THE INVENTION

In an advantage provided by the present invention, an athletic training device is provided which is of a low cost, lightweight manufacture.

Advantageously, this invention provides an athletic training device which is adjustable to simulate ball contact at various heights.

Advantageously, this invention provides an athletic training device which is readily portable.

Advantageously, this invention provides an athletic training device which allows for contact with several balls before the device must be reloaded.

Advantageously, this invention provides an athletic training device which provides realistic follow through after contact with a ball.

Advantageously, this invention provides an athletic training device with retainers which retract after contact with the ball.

In an advantage provided by this invention, an athletic training device is provided which includes a support coupled to a stand and means for bracing the stand. A flexible retainer releasably couples the stand to a ball. Preferably the retainer is coupled to the ball with hook and latch material which allows the ball to release from the flexible holder upon contact.

Advantageously, in a preferred embodiment of the present invention, a plurality of strings are coupled to the support and are provided with means for retracting the stings toward the support subsequent to contact being made with balls coupled to the strings. Preferably, the stand is adjustable to allow strokes of various heights to be simulated.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
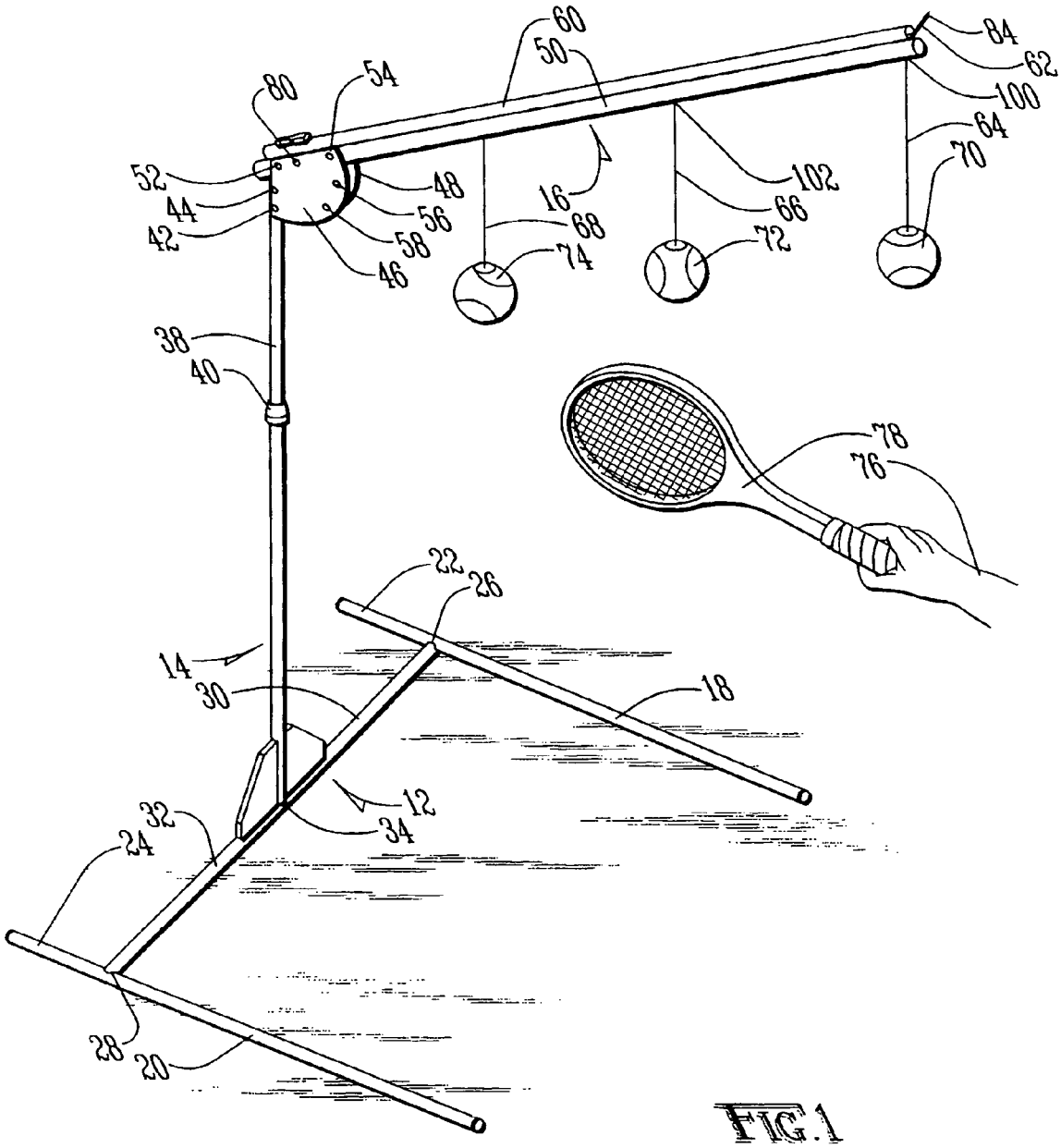
FIG. 1 illustrates a front perspective view of the athletic training device of the present invention being utilized by a user to simulate mid-level strokes.

An athletic training device according to the present invention is shown generally as (10) in FIG. 1. The training device (10) includes a base (12), a stand (14) and a support (16). While the training device (10) may be constructed of any suitable materials, in the preferred embodiment the base (12), stand (14) and support (16) are constructed of Schedule 40 polyvinylchloride ("PVC") tubes. The base (12) is constructed of a pair of long legs (18) and (20), coupled to a pair of short legs (22) and (24) by a pair of PVC "T" connectors (26) and (28). Connected to the "T" connectors (26) and (28) are a pair of return arms (30) and (32). Connecting the return arms (30) and (32) to the stand (14) is another "T" connector (34).

While the stand (14) may be constructed of any desired configuration, in the preferred embodiment the stand (14) is constructed of a lower outer sleeve (36) and an upper inner sleeve (38). Preferably, the inner diameter of the outer sleeve (36) is slightly larger than the outer diameter of the inner sleeve (38), to allow the inner sleeve (38) to telescopically slide within the outer sleeve (36) without substantial restriction. The diameters are preferably similar enough to adequately support the inner sleeve (38) relative to the outer sleeve (36).

Provided on the top of the outer sleeve (36) is a twist-lock device (40), such as those used in association with telescopic paint rollers and the like. The twist-lock (40) may be turned by a user in a first direction to allow the inner sleeve (38) to move freely relative to the outer sleeve (36), and twisted in the opposite direction to lock the position of the inner sleeve (38) in relationship to the outer sleeve (36). Alternatively, the position of the inner sleeve (38) relative to the outer sleeve (36) may be secured using a spring loaded locking pin (not shown) coupled to the inner sleeve (38) and extending through one of a plurality of holes provided in said outer sleeve (36). Secured to the inner sleeve (38) by bolts (42) and (44) are a pair of brackets (46) and (48). While the brackets (46) and (48) may be constructed of any suitable material known in the art, such as steel or the like, in the preferred embodiment the brackets (46) and (48) are constructed of polycarbonate resin or other similar high strength material.

Figure 4:
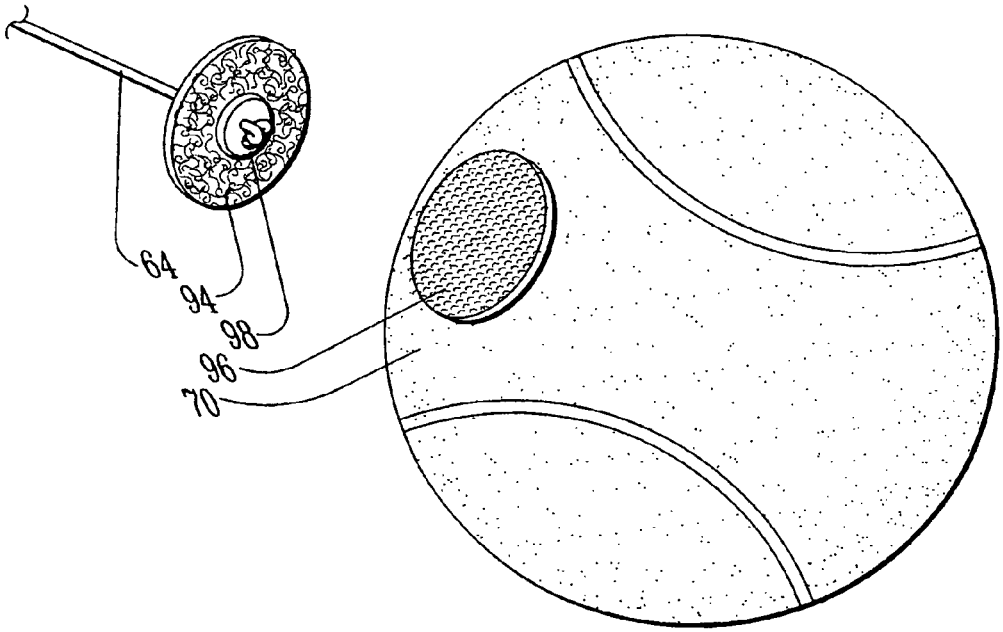
FIG. 4 illustrates a front perspective view of the ball being coupled to the string by hook and latch material.

Also coupled to the brackets (46) and (48) is the arm (50) of the support (16). As shown in FIG. 4, the arm (50) is secured to the brackets (46) and (48) by a pivot bolt (52) and a lock bolt (54). The brackets (46) and (48) are also provided with additional holes (56) and (58) through which the lock bolt (54) may be alternately secured to change the angle of the support (16) relative to the stand (14). For adults, the support (16) is typically angled upward relative to the stand (14) to reduce interference of the support (16) as the user (76) moves toward the stand (14) to strike the innermost ball (74). Slidably coupled onto the back of the arm (50) is an extension (60). Within the extension (60) is provided an overhang (62) described in more detail below.

Depending from the arm (50) are a first string (64), second string (66) and third string (68). While the strings (64), (66) and (68) may be constructed of any suitable material, in the preferred embodiment the strings are constructed of monofilament fishing line, preferably between two and two hundred pound test weight, more preferably between five and fifty pound test weight, and most preferably between eight and twenty pound test weight. Releasably secured to each of the strings (64), (66) and (68) are tennis balls (70), (72) and (74).

As shown in FIG. 1, the stand (14), support (16) and tennis balls (70), (72) and (74) are oriented to simulate a high return stroke. Accordingly, a user (76) may use a racket (78) in conjunction with either a forehand or backhand swing to strike the tennis balls (70), (72) and (74) to increase the accuracy and proficiency of the user's stroke.

Figure 2:
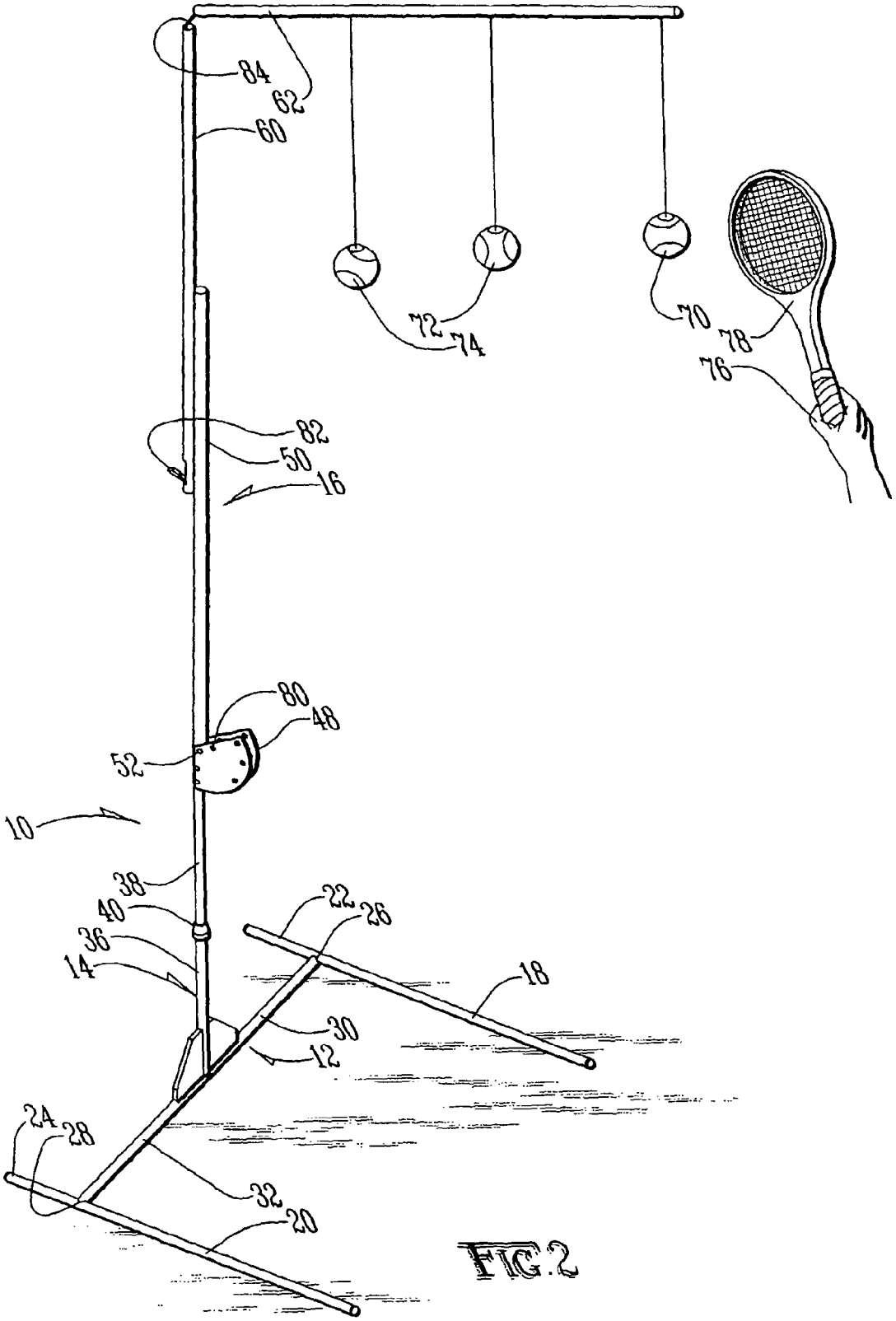
FIG. 2 illustrates a front perspective view of the athletic training device of the present invention shown with a user simulating overhead lob shots and service strokes.

As shown in FIG. 2, when it is desired to replicate a service stroke, the twist lock is twisted to allow the inner sleeve (38) to be extended relative to the outer sleeve (36). Alternatively, multiple telescopic sleeves may be utilized if it is desired to extend the device even higher or to make the device even more compact for transport. If additional height is required, the lock bolt (54) may be removed and the support (16) tilted upward until it pivots on the pivot bolt (52) into contact with the inner sleeve (38). The lock bolt (54) may be then provided through an additional set of holes (80) provided in the brackets (46) and (48) to prevent the support (16) from falling downward. If still additional height is required, the extension (60) may be slid out relative to the arm (50) and retained in place using the lock (82) described in more detail below. The overhang (62), consisting preferably of a steel rod or similar material, is removed from the extension (60) and the bent tip (84) of the overhang (62) is positioned back into the extension (60).

As shown in FIG. 2, the extension (60) is preferably provided with three strings (86), (88) and (90), such as those described above, which may be releasably attached to the tennis balls (70), (72) and (74) to simulate a service swing. The twist lock (40) and extension lock (82) may be manipulated to present the tennis balls (70), (72) and (74) at the desired height. Preferably, the training device (10) can be set up to present the tennis balls (70), (72) and (74) at a height between ground level and five meters high, more preferably between fifty centimeters and four meters high, and most preferably between seventy-five centimeters and three and one-half meters high.

Figure 3:
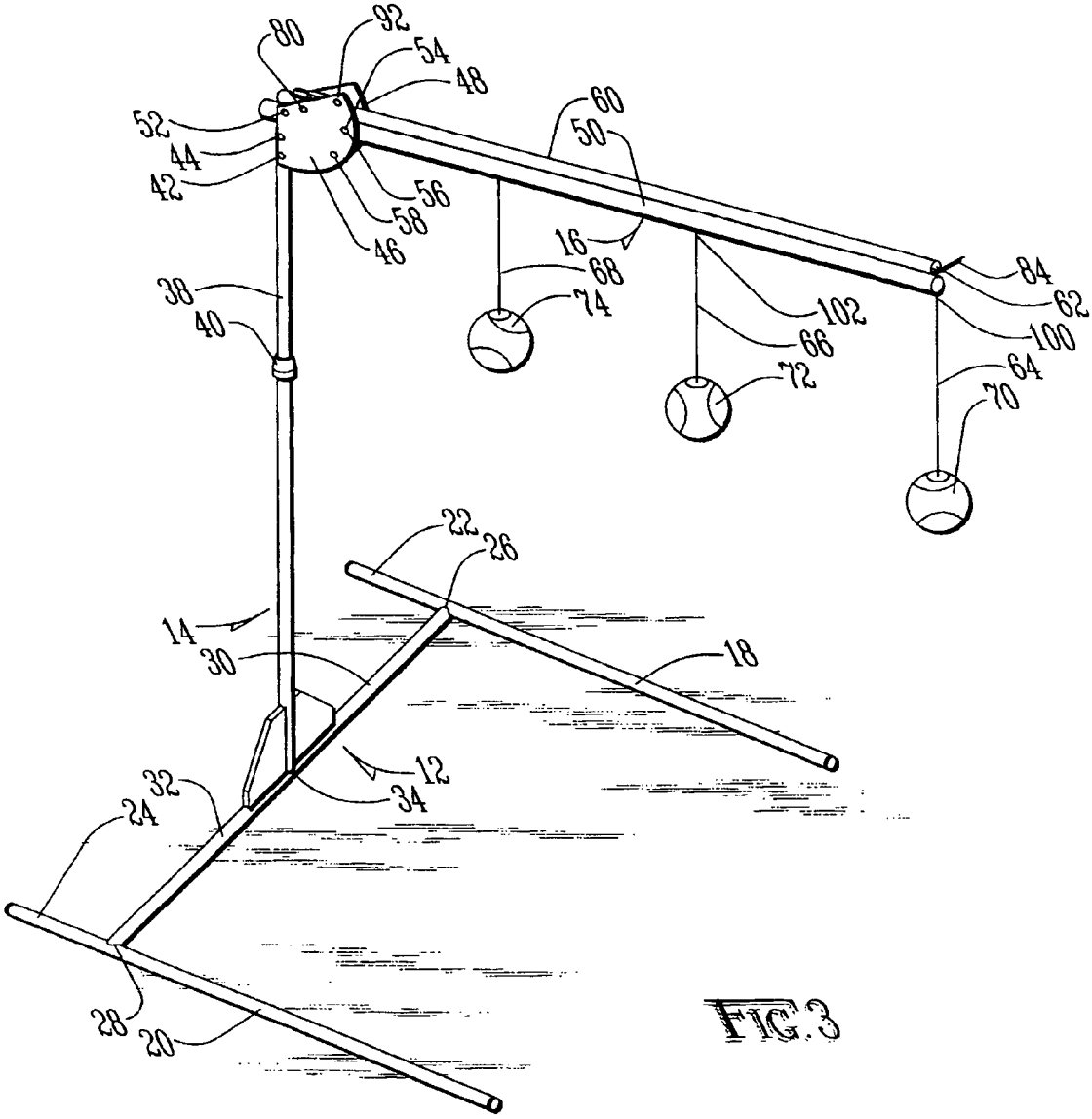
FIG. 3 illustrates a front perspective view of the athletic training device of the present invention being utilized by a user simulating low ground strokes.

As shown in FIG. 3, when it is desired to simulate a lower stroke, the training device (10) of FIG. 1 is adjusted by removing the lock bolt (54), rotating the support (16) downward, and reinserting the lock bolt (54) into the hole (56) from hole (92). Additionally, the twist lock (40) may be used to adjust the height of the inner sleeve (38) relative to the outer sleeve (36).

As shown in FIG. 4, the tennis balls (70), (72) and (74) are coupled to the strings (64), (66) and (68) by two pieces of hook and latch material (94) and (96). As the tennis balls (70), (72) and (74) are all releasably coupled to the strings (64), (66) and (68), description will be limited to a single tennis ball (70) and string (64), with the understanding that the remaining tennis balls (72) and (74) are coupled to the strings (66) and (68) in a like manner.

As shown in FIG. 4, the string (64) extends through a circular piece of hook and latch material (94). The size of the piece of hook and latch material (94) may be adjusted as desired. Preferably, the piece of hook and latch material (94) is sufficiently large and strong to hold the weight of the tennis ball (70), but not so large or strong so as to cause the string (64) to break when the ball (70) is struck by the racket (78). As shown in FIG. 4, the string (64), is preferably sewn into a button (98) or similar type of keeper provided on the opposite side of the hook and latch material (94). Alternatively, the string (64) may be sewn or otherwise secured to the piece of hook and latch material (94) in any desired manner.

The button (98) is preferably large enough so as to prevent the button (98) from being pulled through the piece of hook and latch material (94), but not so large as to substantially interfere with the connection of the piece of hook and latch material (94) to the piece of hook and latch material (96) adhesively secured to the ball (70). Alternatively, given the "fuzzy" nature of the exterior of the tennis ball (70), the hook and latch material (94) may be secured directly to the ball (70). Having a separate a piece of hook and latch material (96) on the tennis ball (70), however, is preferable as such a connection is more secure, more consistent, and reduces damage to the ball (70).

As shown in FIG. 1, the strings (64), (66) and (68) are all coupled to the arm (50) of the support (16). In the preferred embodiment, the string (68) is secured directly to the arm (50) in a manner such as that known in the art. Preferably, however, the string (64) and (66) pass into the arm (50) through holes (100) and (102).

Figure 5:
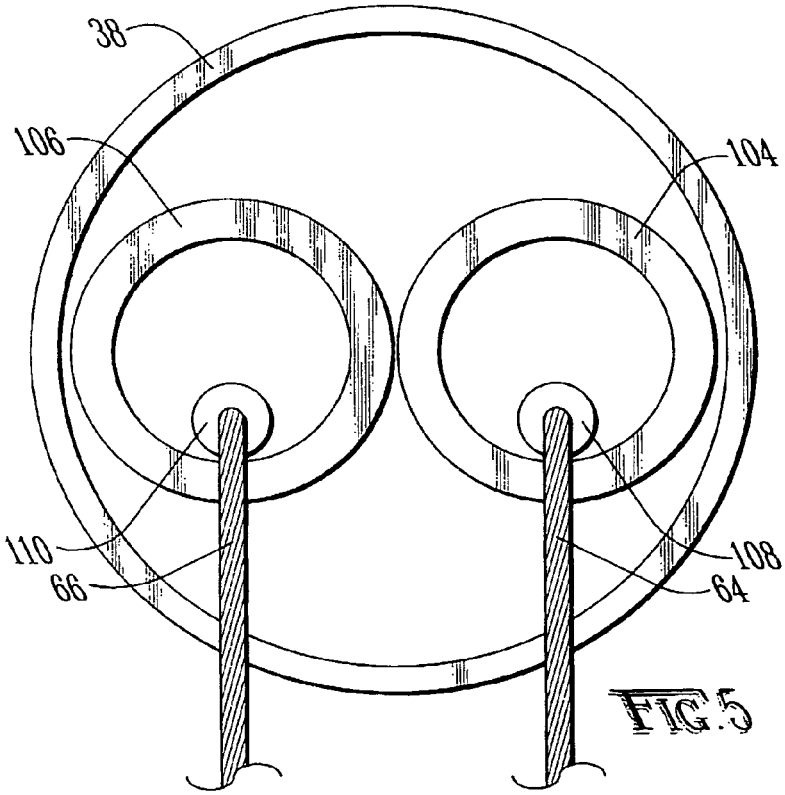
FIG. 5 illustrates a top elevation showing the internal tubes and counterweight system utilized in association with the present invention.

As shown in FIG. 5, two conduit tubes (104) and (106) are wedged snugly within the inner sleeve (38). The strings (64) and (66) preferably pass through the arm (50) and into the conduits (104) and (106) of the inner sleeve (38). Coupled to the ends of the strings (64) and (66) are counter balances (108) and (110) constructed of any dense material of a weight sufficient to effectively counter balance the weights of the tennis balls (70) and (72). The counter balances (108) and (110) are also preferably of a weight sufficient to retract the strings (64) and (66) upon release of the tennis balls (70) and (72) from the strings (64) and (66), without causing damage to the piece of latch and hook material (94) or button (98) upon retraction. Accordingly, the counter balances (108) and (110) allow the user to grasp the tennis balls (70) and (72) and move them upward or downward for fine adjustment. Preferably, however, the tennis balls (70) and (72) are positioned to allow the maximum extension of the strings (64) and (66). When the user (76) strikes the tennis balls (70) and (72) with the racket (78), the impact causes the piece of hook and latch material (94) to release from the hook and latch material (96) coupled to the tennis ball (78), whereafter the counter balance (108) causes the string (64) to retract into the conduit (104), thereby pulling the piece of hook and latch material (94) upward toward the arm (50) of the support (16). This moves the string (64) and piece of hook and latch material (94) out of the way to allow the user (76) to contact the next tennis ball (72) without interference from the string (64).

Figure 6:
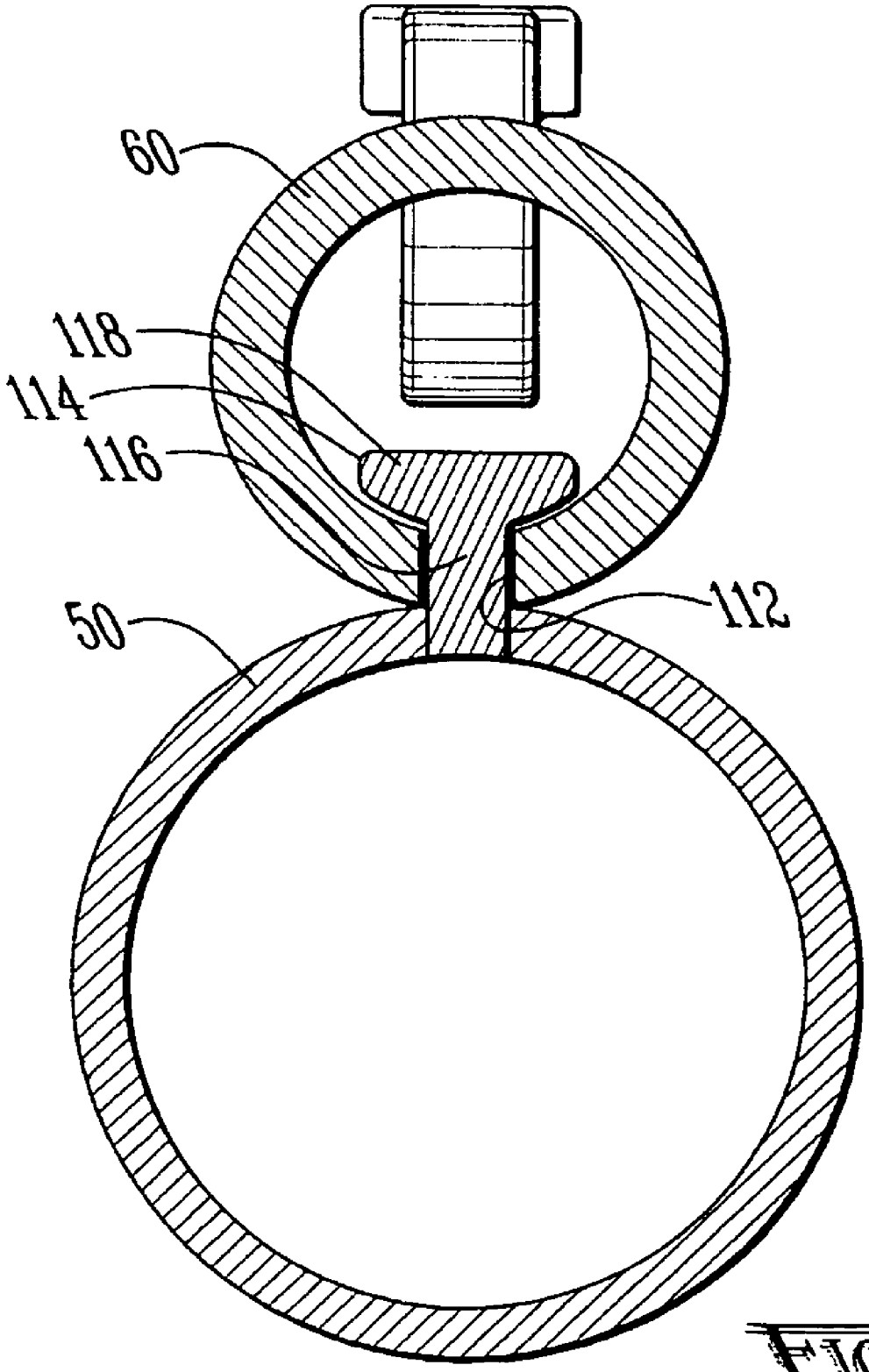
FIG. 6 illustrates a side elevation of the extension arm slidably coupled to the support arm.

Shown in FIG. 6 is the securement of the extension (60) to the arm (50). As shown in FIG. 6, all but approximately the top five centimeters of the extension (60) is provided with a slot (112). The slot (112) is used to couple the extension (60) to a rail (114) secured to the arm (50). While the rail (114) may be of any desired construction, in the preferred embodiment, the rail (114) is provided with a rib (116) only slightly narrower than the slot (112) in the extension (60). Provided over the top of the rib (116) is a retainer (118) running the length of the rib (116). The retainer (118) is of a sufficient width and within sufficient proximity to the arm (50) to securely guide the extension (16) along the arm (50) without allowing the extension (60) to be inadvertently dislodged therefrom.

Figure 7:
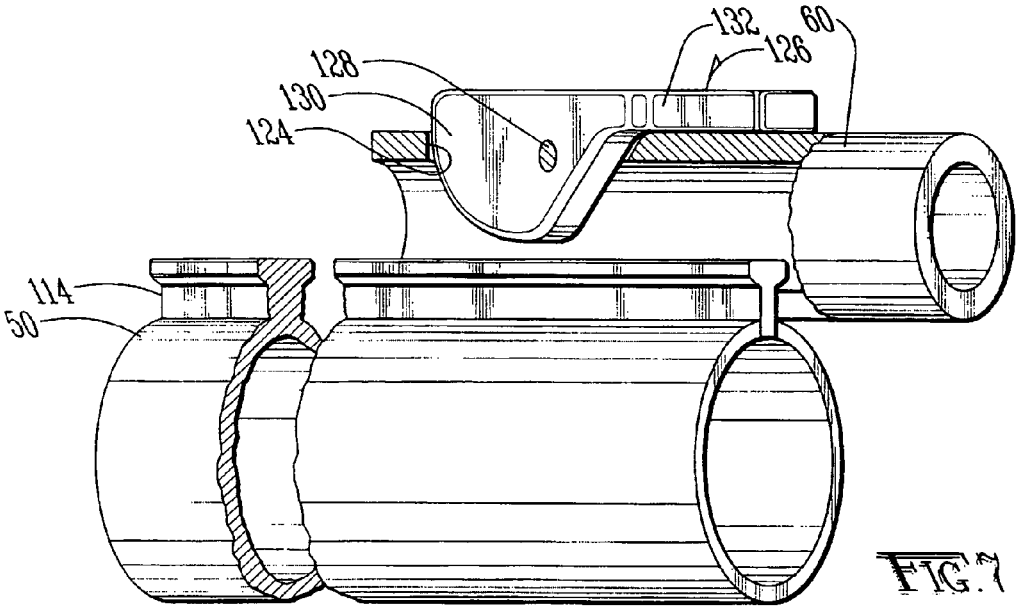
FIG. 7 illustrates a side elevation showing the extension arm sliding relative to the support end.
Figure 8:
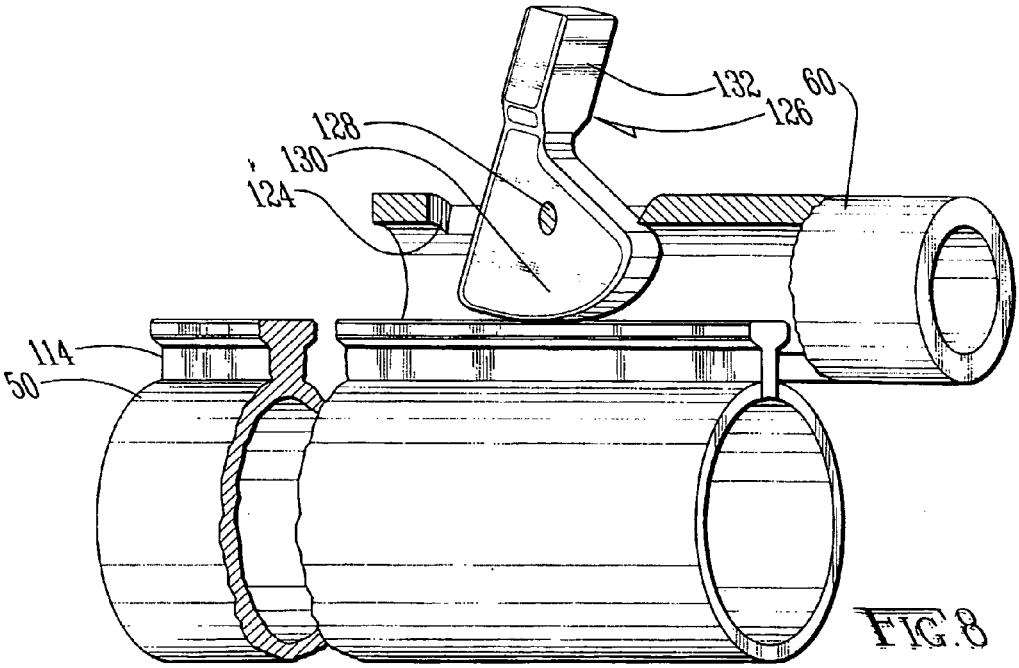
FIG. 8 illustrates a front elevation of the extension arm locked into place relative to the support arm.

Shown in FIG. 7 is the lock mechanism (120) of the extension (60) to secure the extension (60) relative to the arm (50). The extension (60) is provided with a small cutout near its base (124) to receive the lock mechanism (120). A lock member (126) is secured to the extension (60) by a bolt (128) or similar pivotal securement means. As shown in FIG. 7, the lock member (126) is provided on one end with a stop (130) which does not contact the rail (114) when in the unlocked position. When it is desired to lock the extension (60) relative to the arm (50) the actuation end (132) of the lock member (126) is pivoted upward on the bolt (128) to move the stop (130) of the lock member (126) into frictional securement with the rail (114). When it is desired to release the extension (60), the actuation end (132) of the lock member (126) is pivoted downward, thereby allowing the extension (60) to slide freely on the rail (114) relative to the arm (50). Alternatively, it should be noted that any type of set screw or any type of locking mechanism known in the art may be utilized.

Figure 9:
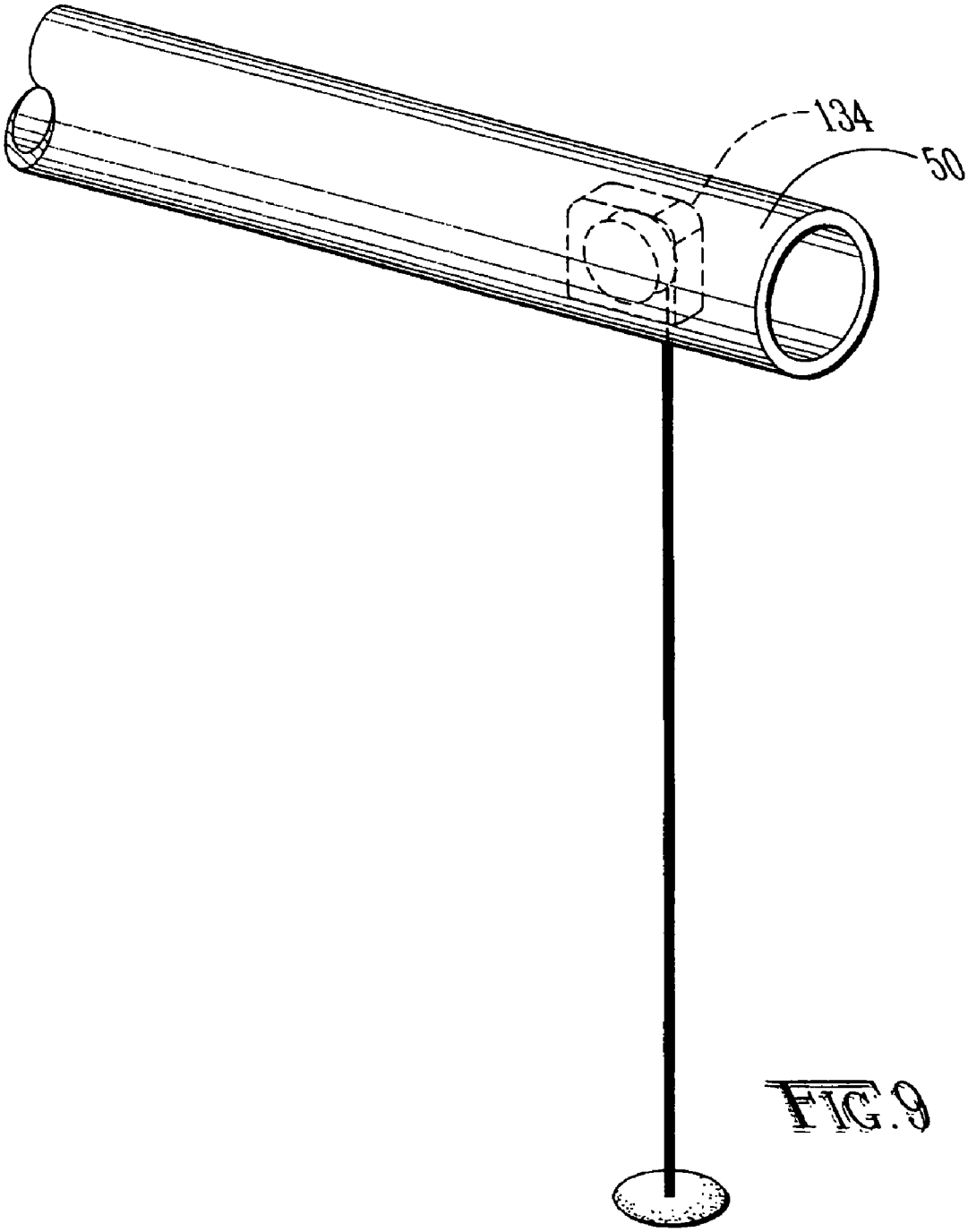
FIG. 9 illustrates a side elevation in partial cross-section of an alternative embodiment of the athletic training device of the present invention, shown utilizing a spring actuated retractor to retract the string.

Shown in FIG. 9 is an alternative embodiment of the present invention in which a spring actuated retraction system, such as those used in association with very small retractable tape measures, may be installed within the arm (50) in lieu of the counterbalances (108) and (110), and conduits (104) and (106). Preferably, the retraction system (134) is of a type which automatically locks when moved to a desired length and then which automatically retracts when pulled and released quickly.

Figure 10:
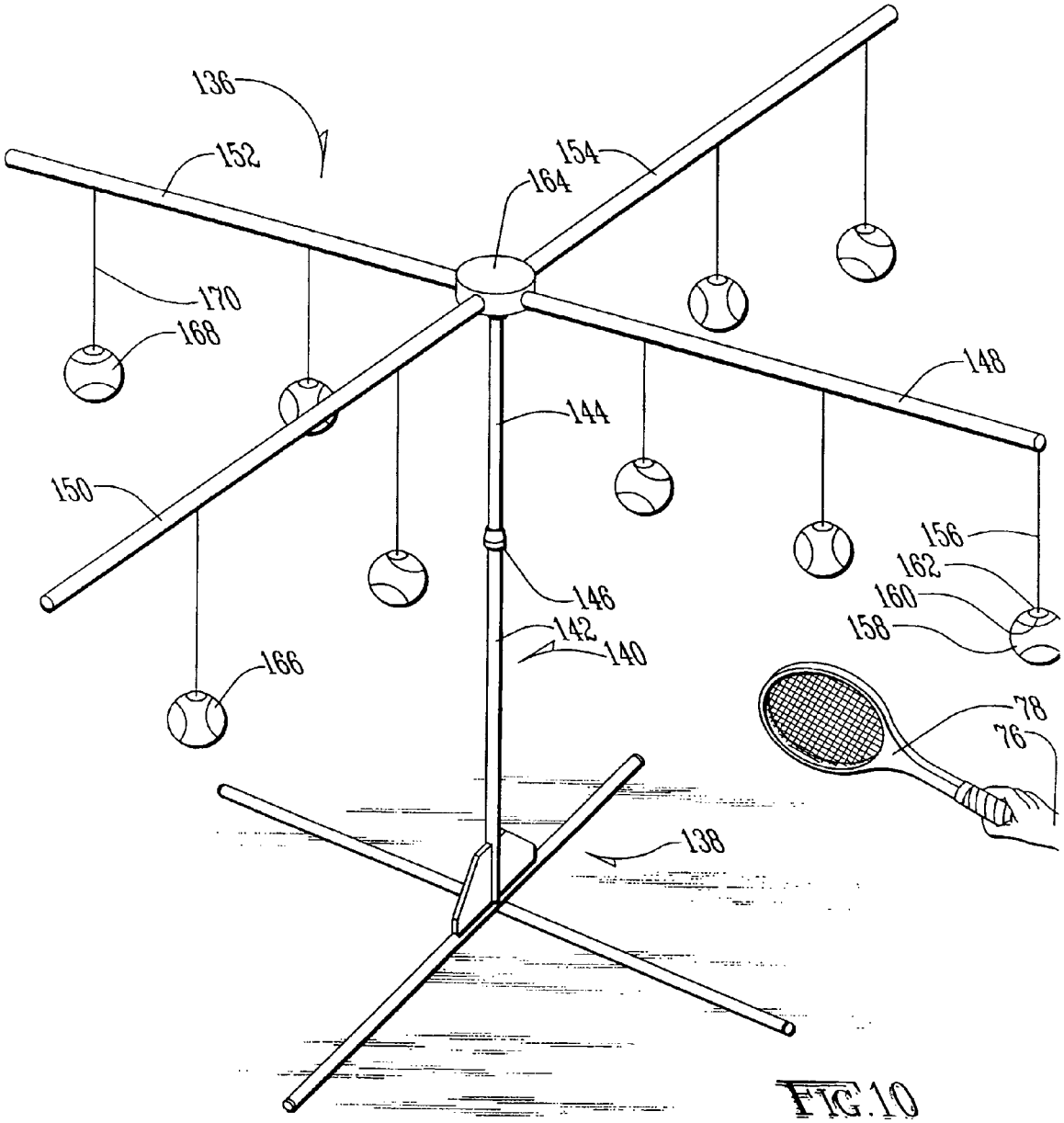
FIG. 10 illustrates a front perspective view of an alternative athletic training device of the present invention shown with a plurality of support arms and a plurality of depending strings and balls.

An alternative embodiment of the present invention is shown generally as (136) in FIG. 10. As shown, the device (136) is provided with an alternative radial base (138), and a stand (140), similar to that described above, having an outer sleeve (142) coupled to an inner sleeve (144) by a twist lock (146). Instead of one support, however, this embodiment of the present invention includes four supports (148), (150), (152) and (154), each provided with a string (156) and ball (158) coupled to one another by hook and latch material (160) and (162). If desired, the supports (148), (150), (152) and (154) may be coupled to a spinner (164) which is then journaled relative to the inner sleeve (144) for rotation in relationship thereto. Accordingly, the user (76) can strike the ball (158) with the racket (78) and then rotate the support (148) by hand or with the racket (78) to move the next tennis ball (166) into the desired position. As shown, one or more tennis balls may be coupled to some of the supports (150) and (154), and used in association with the retraction system described above. If desired, the tennis balls (158) and (168) may be coupled directly to the supports (148) and (152) by the strings (156) and (170), without the need for retraction systems. Also, if desired, the spinner (164) may be coupled to the inner sleeve (144) in a manner which only allows the spinner (164) to rotate in a single direction relative to the inner sleeve (144). This limits the tendency of the supports (148), (150), (152) and (154) to rotate when the user (76) hits a ball with the racket (78) in a first direction. Accordingly, after the user (76) strikes a ball, the spinner (164) does not rotate until the user contacts the supports (148), (150), (152) or (154) to rotate the spinner (164) in a reverse direction to present the next ball for striking.

Figure 11:
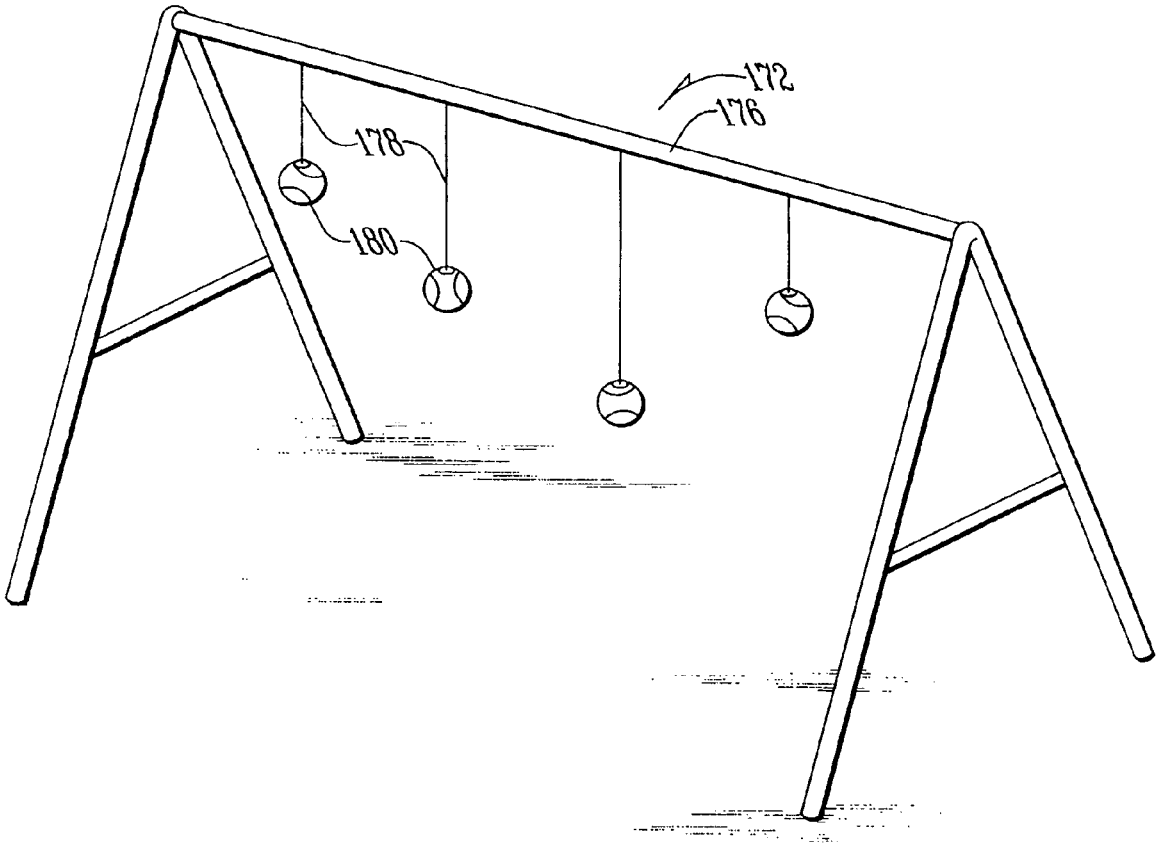
FIG. 11 illustrates a front perspective view of an alternative athletic training device of the present invention shown with the support arm supported on both ends.

Yet another alternative embodiment of the present invention is shown generally as (172) in FIG. 11. In this embodiment of the present invention, a large frame (174) is constructed to support an arm (176) on either end. Depending from the arm (176) are a plurality of strings (178) and tennis balls (180), secured to one another in a manner such as that described above. The strings (178) may either be secured directly to the arm (176) or secured to the arm (176) using one or more of the retraction systems described above. This alternative embodiment (172) of the present invention is particularly useful for practicing service swings or other types of swings where the strings (178) have less of a tendency to interfere with the user's stroke.

Figure 12:
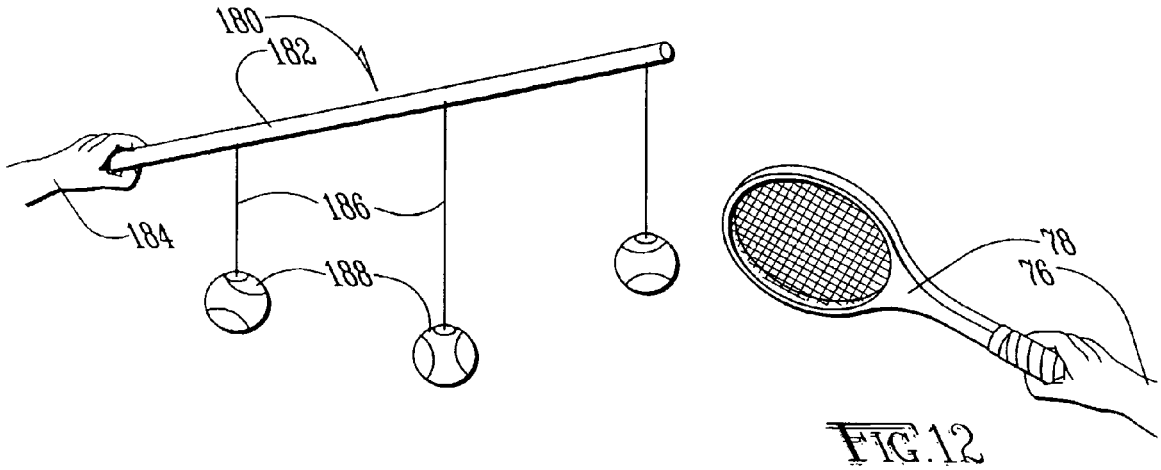
FIG. 12 illustrates a front perspective view of another alternative athletic training device of the present invention being held by an assistant.

Another alternative embodiment of the present invention is shown generally as (180) in FIG. 12. In this embodiment, a support pole (182) is held for the user (76) by an assistant (184). Depending from the pole (182) are a plurality of strings (186) and tennis balls (188) secured to one another in a manner such as that described above. The strings (184) may either be secured directly to the pole (182), or secured to the pole (182) using one or more of the retraction systems described above. This embodiment (180) of the present invention is particularly useful if an assistant (188) is available to hold the pole (182) at the desired height. This embodiment (180) also may require less set-up and maintenance than the preferred embodiment (10).

Although the invention has been described with respect to a preferred embodiment thereof, it is to be understood that it is not to be so limited since changes and modifications can be made therein which are within the full, intended scope of this invention as defined by the appended claims. For example, the training device of the present invention may be utilized in association with racket balls, baseballs, soccer balls, volley balls, golf balls or any type of ball designed to be struck. Additionally, the stand may be secured directly into the ground and constructed of more durable material, such as steel or the like, if a permanent installation is desired. Also, the system may be designed to be friction fit so as to be readily taken down for easy transport and storage.

What is claimed is:

1. An athletic training device comprising:

(a) a stand;

(b) a brace coupled to said stand;

(c) a support coupled to said stand;

(d) a cord coupled to said support;

(e) a cord retracting device coupled to said cord;

(f) a keeper coupled to said cord;

(g) a ball;

(h) wherein said cord retracting device is configured to retract said cord in a first direction opposite a second direction in which said ball is moving while said ball is moving in said second direction;

(i) wherein said cord retracting device is provided with a retraction mechanism insufficient to retract said cord when said cord is attached to said ball, but sufficient to retract said cord when said ball is released from said cord, whereby the weight of said ball prevents said retraction mechanism from retracting said cord until said ball is released from said cord;

(j) a catch coupled to said ball; and (k) wherein said catch is releasably coupled to said keeper.

2. The athletic training device of claim 1, wherein said support is angled relative to said stand.

3. The athletic training device of claim 1, wherein said stand is rigid.

4. The athletic training device of claim 3, wherein said stand support is rigid.

5. The athletic training device of claim 4, wherein said cord retracting device is configured to retract said cord into said support.

6. The athletic training device of claim 5, further comprising:

(a) a supplemental cord coupled to said support;

(b) a supplemental keeper coupled to said supplemental cord;

(c) a supplemental ball;

(d) a supplemental catch coupled to said supplemental ball, wherein said supplemental catch is releasably coupled to said supplemental keeper.

7. The athletic training device of claim 1, further comprising a supplemental support coupled to and angled relative to said support.

8. The athletic training device of claim 7, further comprising a supplemental cord coupled to said supplemental support.

9. The athletic training device of claim 1, further comprising:

(a) a supplemental cord coupled to said support;

(b) a supplemental keeper coupled to said supplemental cord;

(c) a supplemental ball;

(d) a supplemental catch coupled to said supplemental ball;

(e) wherein said supplemental catch is releasably coupled to said releasable keeper; and (f) a supplemental cord retracting device coupled to said supplemental cord.

10. The athletic training device of claim 1, wherein a lowermost portion of said stand is located between one and three meters below said ball.

11. The athletic training device of claim 1, further comprising means for adjusting an angle of said support relative to said stand by at least ten degrees.

12. The athletic training device of claim 1, further comprising means for adjusting a height of said support relative to a bottom of said stand at least one meter.

13. The athletic training device of claim 1, wherein said catch maintains said ball between one meter and three meters above a bottom of said stand.

14. An athletic training device comprising:

(a) a support arm;

(b) a first cord coupled to said support arm;

(c) a first ball;

(d) a first releasable fastener coupled between said first cord and said first ball;

(e) a second cord coupled to said support arm;

(f) a second ball;

(g) a second releasable fastener coupled between said second cord and said second ball;

(h) a cord retracting device coupled to said first cord; and (i) wherein said cord retracting device is configured to retract said cord in a first direction opposite a second direction in which said ball is moving while said ball is moving in said second direction; and (j) wherein said cord retracting device is provided with a retraction mechanism insufficient to retract said cord when said cord is attached to said ball, but sufficient to retract said cord when said ball is released from said cord, whereby the weight of said ball prevents said retraction mechanism from retracting said cord until said ball is released from said cord.

15. The athletic training device of claim 14, further comprising a stand coupled to said support arm.

16. The athletic training device of claim 15, wherein said stand is telescopic.

17. The athletic training device of claim 15, wherein said first cord suspends a first ball between one-half meter and three meters off the ground.

18. An athletic training device comprising:

(a) an upright stand;

(b) a support arm coupled to said stand;

(c) a first cord coupled to said support arm;

(d) a first ball;

(e) a first releasable fastener coupled between said first cord and said first ball;

(f) a first cord retracting device coupled to said first cord;

(g) wherein said first cord retracting device is configured to retract said first cord in a first direction opposite a second direction in which said first ball is moving, while said first ball is moving in said second direction (h) wherein said first cord retracting device is provided with a first retraction mechanism insufficient to retract said first cord when said first cord is attached to said ball, but sufficient to retract said first cord when said ball is released from said first cord, whereby the weight of said ball prevents said first retraction mechanism from retracting said first cord until said ball is released from said first cord;

(i) a second cord coupled to said support arm;

(j) a second ball;

(k) a second a second releasable fastener coupled between said second cord and said second ball;

(l) a second cord retracting device coupled to said second cord;

(m) wherein said second cord retracting device is configured to retract said second cord in a third direction opposite a fourth direction in which said second ball is moving, while said second ball is moving in said fourth direction;

(n) wherein said second cord retracting device is provided with a second retraction mechanism insufficient to retract said second cord when said second cord is attached to said ball, but sufficient to retract said second cord when said ball is released from said second cord, whereby the weight of said ball prevents said second retraction mechanism from retracting said second cord until said ball is released from said second cord;

(o) a third cord coupled to said support arm;

(p) a third ball; and (q) a third releasable fastener coupled between said third cord and said third ball.

19. The athletic training device of claim 18, wherein said stand is telescopic.

20. The athletic training device of claim 18, further comprising an extension arm coupled to said support arm.

* * * * *